US010016107B2

(12) United States Patent
Thorne

(10) Patent No.: US 10,016,107 B2
(45) Date of Patent: Jul. 10, 2018

(54) SURFACE CLEANING APPARATUS WITH A SIDEWAYS PIVOTING HANDLE

(71) Applicant: SharkNinja Operating LLC, Newton, MA (US)

(72) Inventor: Jason Boyd Thorne, Dover, MA (US)

(73) Assignee: SharkNinja Operating LLC, Needham, MA (US)

( * ) Notice: Subject to any disclaimer, the term of this patent is extended or adjusted under 35 U.S.C. 154(b) by 672 days.

(21) Appl. No.: 13/713,728

(22) Filed: Dec. 13, 2012

(65) Prior Publication Data

US 2013/0152337 A1 Jun. 20, 2013

Related U.S. Application Data

(60) Provisional application No. 61/570,573, filed on Dec. 14, 2011.

(51) Int. Cl.
*A47L 9/00* (2006.01)
*A47L 9/32* (2006.01)

(52) U.S. Cl.
CPC ..... *A47L 9/00* (2013.01); *A47L 9/325* (2013.01)

(58) Field of Classification Search
CPC ..... A47L 5/28; A47L 9/02; A47L 9/32; A47L 11/34; A47L 9/325; A47L 5/32; Y10S 15/10
USPC ..... 15/410, 411, 334, 335; 403/103, 104, 403/91–102, 112, 113, 116, 117
See application file for complete search history.

(56) References Cited

U.S. PATENT DOCUMENTS

| | | | | |
|---|---|---|---|---|
| 2,038,697 A * | 4/1936 | Winslow | 280/47.34 |
| 2,039,861 A * | 5/1936 | Watts | 15/410 |
| 2,170,963 A * | 8/1939 | Dahl | 285/7 |
| 2,796,619 A * | 6/1957 | Hammer | 15/172 |
| 3,306,634 A * | 2/1967 | Groves et al. | 285/7 |
| 4,982,732 A * | 1/1991 | Morris | 602/16 |
| 5,584,095 A | 12/1996 | Redding et al. | |

(Continued)

FOREIGN PATENT DOCUMENTS

| | | |
|---|---|---|
| CA | 2697025 A1 | 2/2004 |
| CA | 2495053 C | 7/2010 |

(Continued)

OTHER PUBLICATIONS

Third Party Submission filed on Oct. 13, 2015 in U.S. Appl. No. 14/341,101, 70 pgs.

(Continued)

*Primary Examiner* — Joseph J Hail
*Assistant Examiner* — J Stephen Taylor
(74) *Attorney, Agent, or Firm* — Grossman Tucker Perreault & Pfleger, PLLC

(57) ABSTRACT

A surface cleaning apparatus comprises:
(a) a cleaning head having a front, a rear, two opposed sides extending between the front and the rear, a bottom and a dirty air inlet;
(b) an airflow path extending from the dirty air inlet to a clean air outlet;
(c) a suction motor and an air treatment member positioned in the airflow path;
(d) an upright section moveably mounted with respect to the cleaning head between a storage position and a rearward in-use position; and,
(e) the upright section also pivotally mounted for movement sideways with respect to the cleaning head between a centered position and a sideways position.

21 Claims, 11 Drawing Sheets

(56) References Cited

U.S. PATENT DOCUMENTS 5,794,305 A * 8/1998 Weger ..... 15/411
D400,324 S 10/1998 Bobrosky et al.
6,055,703 A 5/2000 Redding et al.
D435,324 S 12/2000 Paterson et al.
D435,945 S 1/2001 Ikeno et al.
D435,947 S 1/2001 Paterson et al.
D436,426 S 1/2001 Paterson et al.
D443,121 S 5/2001 Hamm et al.
6,345,408 B1 * 2/2002 Nagai et al. ..... 15/361
D455,876 S 4/2002 Arney et al.
6,364,562 B1 * 4/2002 Tung ..... 403/93
D473,981 S 4/2003 Wareham
D475,820 S 6/2003 Dyson et al.
D481,180 S 10/2003 Fujii
D487,172 S 2/2004 Oh et al.
D494,719 S 8/2004 Rosenzweig et al.
D509,934 S 9/2005 Santiago et al.
D510,465 S 10/2005 Takahashi et al.
D516,259 S 2/2006 Richardson et al.
D518,928 S 4/2006 Chiba
D521,699 S 5/2006 Greene et al.
7,037,287 B2 * 5/2006 Cormier et al. ..... 602/23
7,048,804 B2 5/2006 Kisela et al.
D525,400 S 7/2006 Luebbering et al.
D531,770 S 11/2006 Luebbering et al.
D532,168 S 11/2006 Elrod
D532,943 S 11/2006 Haranaka
D532,944 S 11/2006 Choi
D533,976 S 12/2006 Luebbering et al.
D535,070 S 1/2007 Shin
D537,584 S 2/2007 Greene et al.
D537,994 S 3/2007 Leyden
D541,497 S 4/2007 Elrod
D547,505 S 7/2007 Carr et al.
D548,412 S 8/2007 Bobrosky
D549,905 S 8/2007 Bobrosky et al.
D553,313 S 10/2007 Parr et al.
7,293,322 B2 11/2007 Matousek et al.
D587,870 S 3/2009 Baek et al.
7,503,098 B2 3/2009 Stein et al.
7,581,284 B2 9/2009 Courtney et al.
7,581,285 B2 9/2009 Courtney et al.
7,600,292 B2 10/2009 Courtney et al.
7,610,653 B2 11/2009 Courtney et al.
D608,064 S 1/2010 Conrad et al.
D608,962 S 1/2010 Reese et al.
D609,418 S 2/2010 Santiago et al.
D611,210 S 3/2010 Conrad et al.
D612,114 S 3/2010 Keno
D614,370 S 4/2010 Dyson et al.
7,757,343 B2 7/2010 Courtney et al.
7,805,804 B2 * 10/2010 Loebig ..... 15/351
7,823,251 B2 11/2010 Dyson et al.
7,854,039 B2 * 12/2010 Lee ..... A47L 9/327 15/144.1
D631,628 S 1/2011 Benacquisto et al.
D632,035 S 2/2011 Luyckx et al.
D632,036 S 2/2011 McNeil et al.
D632,037 S 2/2011 Carr et al.
7,879,142 B2 2/2011 Han et al.
D637,777 S 5/2011 Fiorino et al.
7,979,953 B2 7/2011 Yoo
8,032,983 B2 10/2011 Griffith et al.
D648,087 S 11/2011 Park et al.
8,091,169 B2 * 1/2012 Jeutter et al. ..... 15/41.1
D662,271 S 6/2012 Conrad et al.
D662,272 S 6/2012 Conrad et al.
D662,677 S 6/2012 Bilger et al.
8,268,029 B2 9/2012 Yoo
8,468,649 B2 * 6/2013 Nielsen et al. ..... 15/415.1
D694,970 S 12/2013 Santiago et al.
8,661,613 B2 * 3/2014 Marsh et al. ..... 15/411
8,869,348 B2 * 10/2014 Conrad ..... 15/411
8,869,349 B2 10/2014 Henderson
2002/0101075 A1 * 8/2002 Park ..... A47L 9/242 285/7
2006/0218741 A1 10/2006 Kang
2007/0209147 A1 9/2007 Krebs et al.
2008/0178420 A1 7/2008 Conrad
2009/0056058 A1 3/2009 Finke et al.
2009/0056059 A1 3/2009 Mersmann et al.
2009/0056061 A1 3/2009 Andrup et al.
2009/0265819 A1 10/2009 Scott
2010/0139030 A1 6/2010 Yoo
2010/0175217 A1 7/2010 Conrad
2011/0107553 A1 5/2011 Myers et al.
2011/0219574 A1 9/2011 Conrad
2011/0219580 A1 9/2011 Conrad
2011/0219581 A1 9/2011 Vines et al.
2011/0225764 A1 9/2011 Muhlenkamp et al.
2012/0060322 A1 * 3/2012 Simonelli ..... A47L 9/009 15/411
2013/0152337 A1 * 6/2013 Thorne ..... 15/410
2014/0013537 A1 1/2014 Kasper
2014/0331445 A1 11/2014 Thorne et al.

FOREIGN PATENT DOCUMENTS

CA 2495066 C 5/2011
CA 2495073 C 5/2011
CA 2718836 A1 5/2011
JP 200626170 A 2/2006

OTHER PUBLICATIONS

U.S. Office Action dated Aug. 23, 2017, received in U.S. Appl. No. 14/341,101, 34 pgs.

* cited by examiner

SURFACE CLEANING APPARATUS WITH A SIDEWAYS PIVOTING HANDLE

RELATED APPLICATIONS

This application hereby claims the benefit of and priority to U.S. Provisional Application Ser. No. 61/570,573 filed on Dec. 14, 2011, under 35 U.S.C. §§ 119, 120, 363, 365, and 37 C.F.R. § 1.55 and § 1.78, which is incorporated herein by reference.

FIELD

The application relates to a surface cleaning apparatus, such as a vacuum cleaner with a handle or upright section that is pivotal sideways as well as rearwardly.

BACKGROUND

Upright vacuum cleaners are known. An upright vacuum cleaner has a surface cleaning head and an upright section moveably mounted thereto. The upright section is moveable between an upright or storage position and a rearward or in use position.

In order to assist steering the cleaning head, it is known to permit the upright section to rotate about the longitudinal axis of the upright section.

SUMMARY

In accordance with this disclosure, an upright or handle section of a surface cleaning apparatus is moveable rearwardly so as to enable the handle or upright section to move to a rearward in use position. In addition, the upright or handle section is also pivotal sideways.

An advantage of this design is that the maneuverability of the surface cleaning head is enhanced by pivoting the upright or handle section sideways.

A further advantage is that the linkage to permit the sideways pivot may be simpler and more reliable then the construction to permit the upright section to rotate about the longitudinal axis of the upright section.

Further, a biasing member such as a spring may be easily provided to counteract some or all of the hand weight that arises due to the sideways pivot of the upright or handle section.

In a first aspect, there is provided a surface cleaning apparatus comprising:

(a) a cleaning head having a front, a rear, two opposed sides extending between the front and the rear, a bottom and a dirty air inlet;

(b) an airflow path extending from the dirty air inlet to a clean air outlet;

(c) a suction motor and an air treatment member positioned in the airflow path;

(d) an upright section moveably mounted with respect to the cleaning head between a storage position and a rearward in-use position; and, (e) the upright section also pivotally mounted for movement sideways with respect to the cleaning head between a centered position and a sideways position.

In one embodiment, the apparatus further comprises a biasing member biasing the upright section towards the centered position.

In another embodiment, the upright section is moveably mounted with respect to the cleaning head about a first axis of rotation, and the upright section is pivotally mounted with respect to the cleaning head about a second axis of rotation.

In another embodiment, the second axis of rotation is above the first axis of rotation.

In another embodiment, the first axis of rotation is generally parallel to the front and the second axis of rotation is generally parallel to a forward direction of motion of the cleaning head.

In another embodiment, each axis of rotation comprises a pivot axis, and the first pivot axis is generally perpendicular to the second pivot axis.

In another embodiment, the apparatus further comprises a flexible hose defining at least a portion of the airflow path that conveys dirty air past the second axis of rotation.

In another embodiment, the apparatus further comprises a first hollow support member pivotally connected to a second hollow support member wherein the flexible hose extends through the interior of the first and second hollow support members.

In another embodiment, each hollow support member comprises a tubular conduit.

In another embodiment, the apparatus further comprises a pivot lock inhibiting the sideways pivoting of the upright section.

In another embodiment, the apparatus further comprises a pivot limiter delimiting the sideways pivoting of the upright section to a maximum sideways pivot angle from the centered position.

In another embodiment, the pivot limiter comprises a stop which is engaged when the upright section is pivoted sideways to the maximum sideways pivot angle.

In another embodiment, wherein the pivot limiter defines a plurality of maximum sideways pivot angles.

In another embodiment, the apparatus further comprises a selector that is adjustable to select one of the pluralities of maximum sideways pivot angles.

In another embodiment, the selector is part of the pivot limiter.

In another embodiment, the cleaning head comprises a first support member and the upright section comprises a second support member, each of the support members extending along a longitudinal axis and the pivot limiter is rotatably mounted to one of the support members for rotation about the longitudinal axis.

In another embodiment, the pivot limiter comprises a plurality of first interacting members and the other of the support members comprises a second interacting member, and one of the first interacting members and the second interacting member abut when the upright section is positioned at a set variable maximum sideways pivot angle.

In another embodiment, the pivot limiter is rotatably mounted to the second support member.

In another embodiment, the first interacting members comprise a plurality of stops at various distances from the second interacting member when the upright section is in the centered position and the selector is rotatable to align one of the stops with the second interacting member.

In another embodiment, the first interacting members comprise a plurality of recesses and the selector is rotatable to align one of the recesses with the second interacting member.

BRIEF DESCRIPTION OF THE DRAWINGS

A preferred embodiment of the present invention will now be described in detail with reference to the drawings, in which:

FIG. 5 FIG. 4 is a cross section along line 4-4 in FIG. 1 of the vacuum cleaner of FIG. 1 in a centered position;

Figure 1:
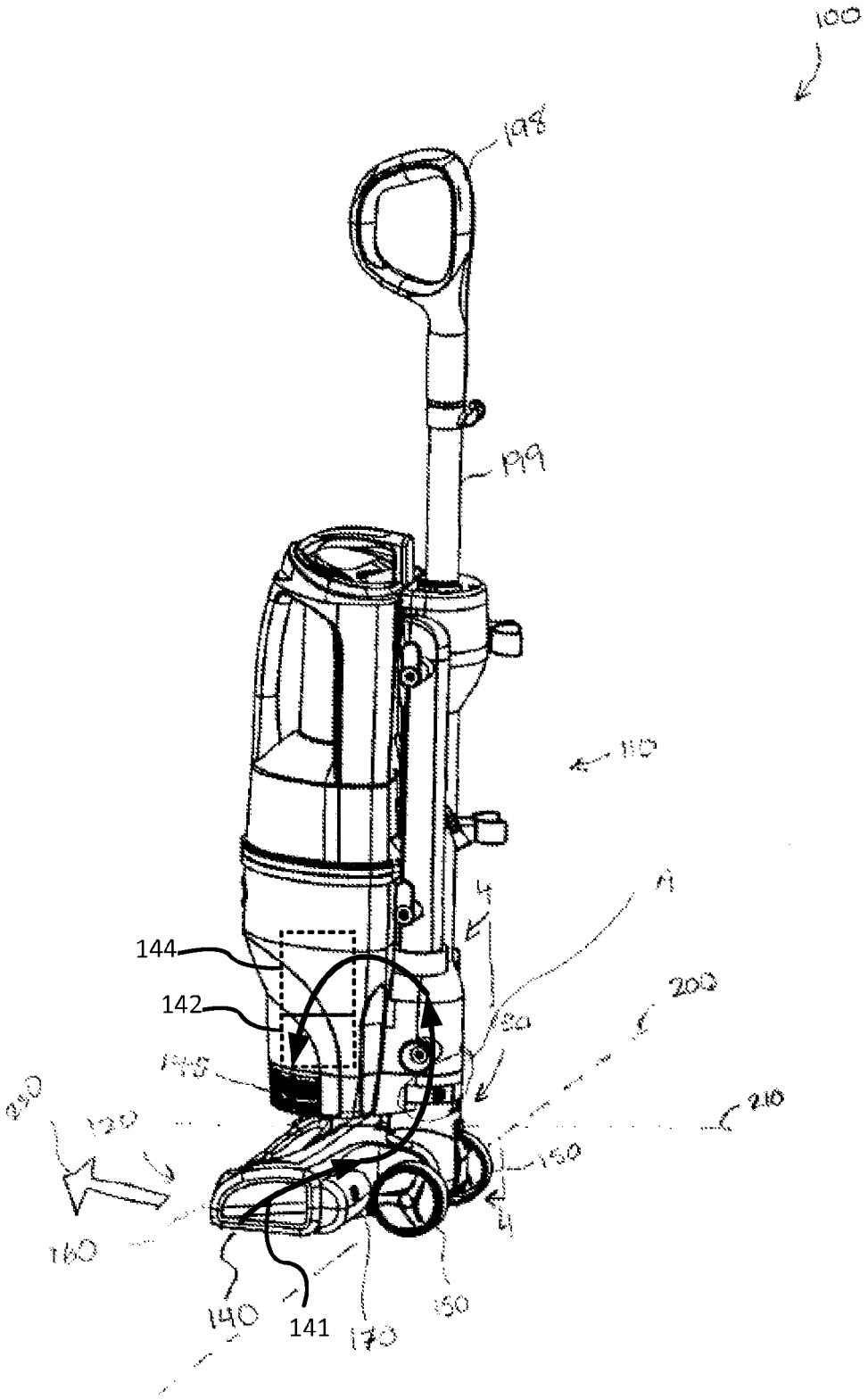
FIG. 1 is a perspective view of a vacuum cleaner in a storage position.
Figure 6:
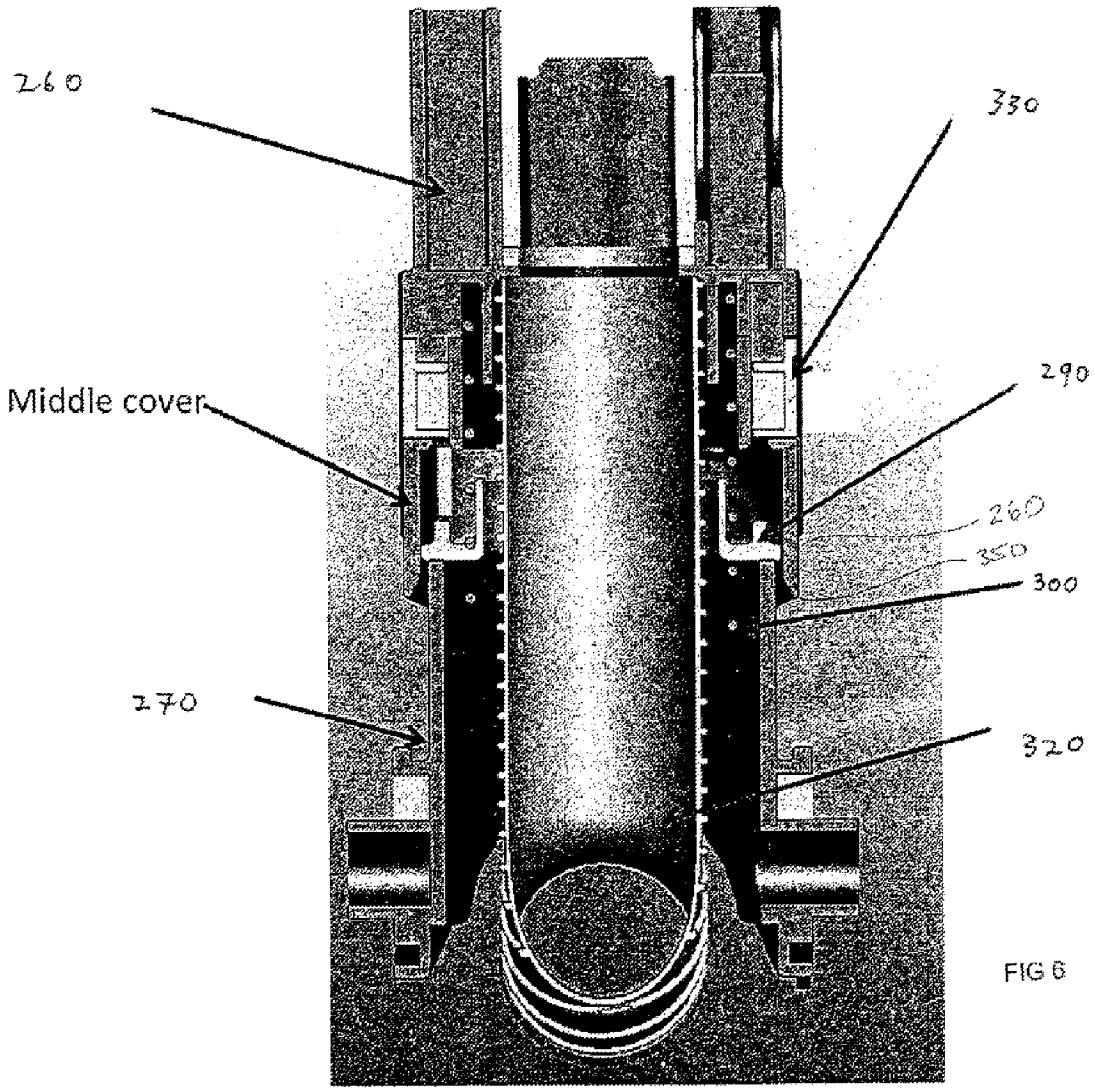
Figure 7:
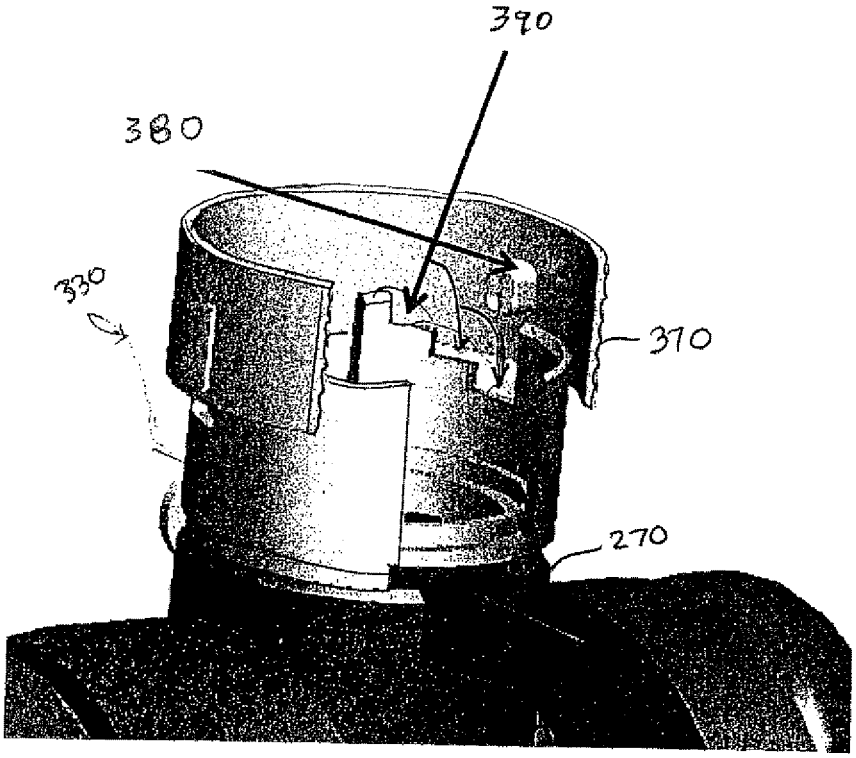

in a sideways pivoted position;

FIG. 6 is a cross section along line 4-4 in FIG. 1 of the vacuum cleaner of FIG. 1 in a centered position showing the flexible hose;

FIG. 7 is a partially exploded view of area A of FIG. 1; and,

FIGS. 8A-8D are each a cross section along line 4-4 in FIG. 1 of the vacuum cleaner of FIG. 1 in a centered position and the selector in a different position.

DESCRIPTION OF EXEMPLARY EMBODIMENTS

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Figure 2:
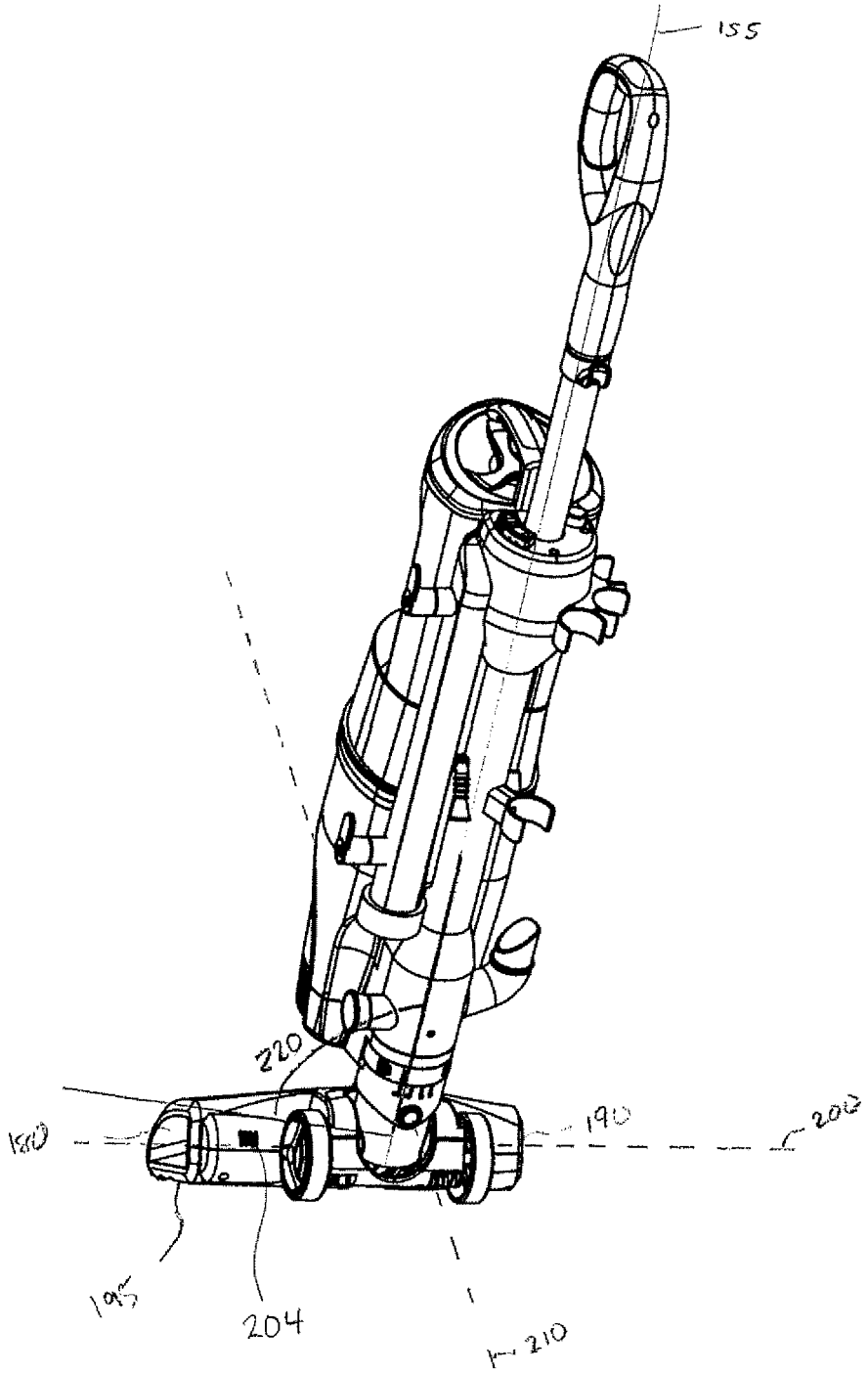
FIG. 2 is a perspective view of the vacuum cleaner of FIG. 1 in a centered position and a rearward in use position.
Figure 3:
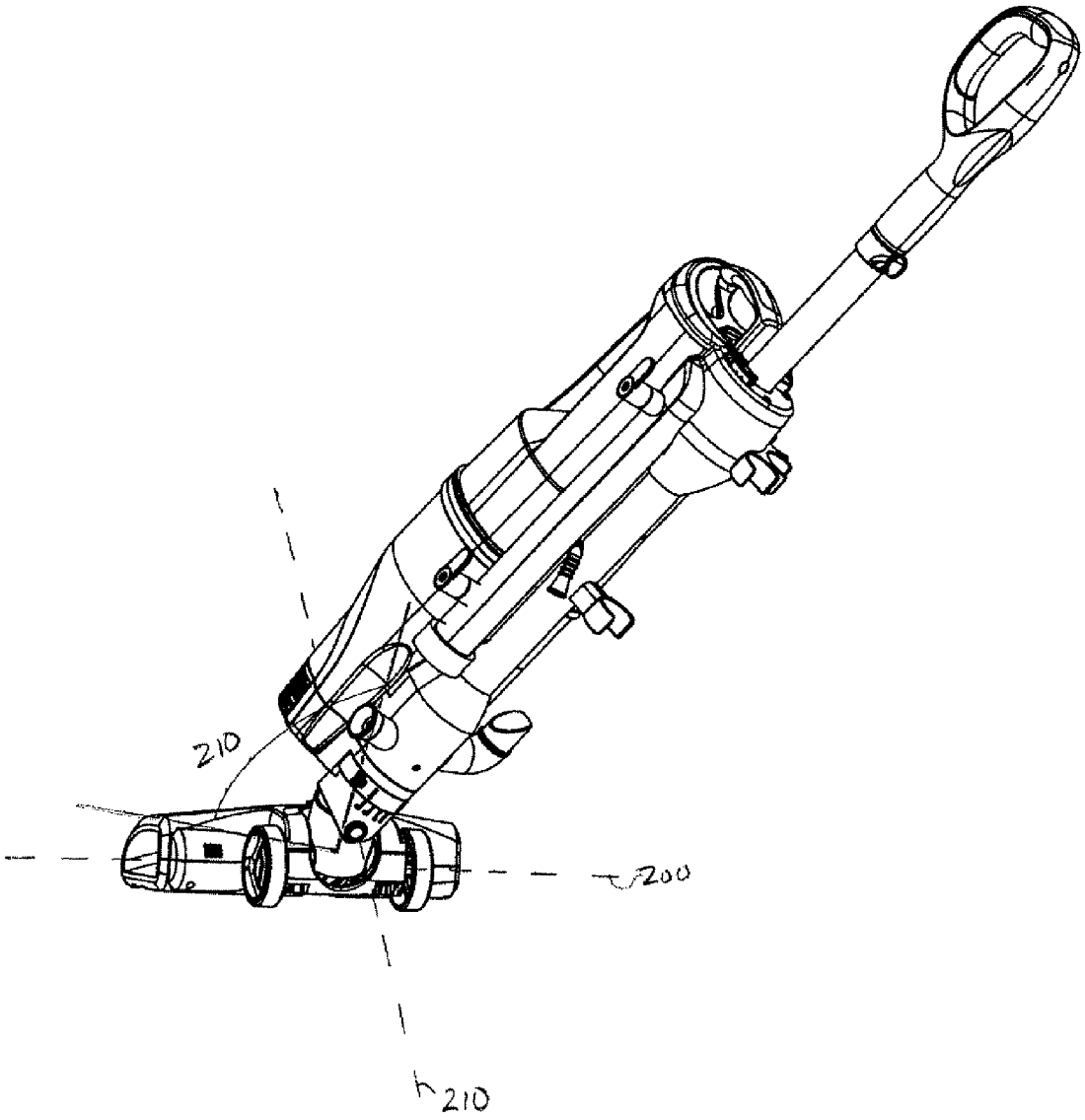
FIG. 3 is a perspective view of the vacuum cleaner of FIG. 1 in a sideways pivoted position and a rearward in use position.

FIGS. 1-3 exemplify an upright surface cleaning apparatus. In the present example the upright surface cleaning apparatus is an upright vacuum cleaner 100 comprising an upright section 110 movably moveably mounted with respect to the cleaning head 120 between a storage position and a rearward in-use position.

Upright section 110 may be connected to cleaning head 120 via a coupling portion 130. In alternate embodiments the upright surface cleaning apparatus may be a shampooing carpet cleaner, steam cleaner or other apparatus generally comprising an upright section movably connected to a cleaning head via a coupling portion.

The term coupling portion is used to generally describe elements of the vacuum cleaner 100 that are associated with a region where the upright section 110 is joined to the cleaning head 120 and is not limited to any particular embodiment or assembly of parts. The coupling portion 130 may include multiple structural components or portions of one or both of the upright section 110 and the cleaning head 120 as well as additional elements described in more detail below.

As exemplified, the cleaning head 120 comprises a dirty air inlet 140 for sucking in air with entrained dirt from the surface being cleaned. The cleaning head 120 has a front 160, a rear 170, two opposed sides 180, 190 extending between front 160 and rear 170 and a bottom 195. In the example shown, the cleaning head 120 has a generally cuboid shape with parallel opposed sides 180, 190 and parallel opposed front and rear ends 160, 170. It will be appreciated that the cleaning head may take any suitable regular or irregular form such as a wedge shape or the shape of an extruded triangle which may permit the cleaning head 120 to clean in hard to reach places. Dirty air inlet 140 may be provided in bottom 195 proximate front 160.

In the example shown, the vacuum cleaner 100 includes a pair of rear wheels 150, for rollably engaging the surface being cleaned. In some examples, the vacuum cleaner 100 may include additional support wheels (e.g., a pair of front wheels). In other examples, the vacuum cleaner 100 may include sliding pads instead of or in addition to wheels. In some embodiments, the wheels may be removably attachable which may permit entangled fibers and hair to be cleared from their axles.

An airflow path 141 extends from the dirty air inlet 140 to the clean air outlet 145. The clean air outlet may be located in the upright section 110, in the cleaning head 120 or elsewhere on the vacuum cleaner 100 as is known in the art. Preferably, the clean air outlet is provided in upright section 110.

The vacuum cleaner 100 of FIGS. 1-3 includes a suction motor 142 and an air treatment member 144 which are positioned in the airflow path 141 between the dirty air inlet 140 and the clean air outlet 145. The suction motor and the air treatment member may be located in one or both of the upright section 110, the cleaning head 120 or elsewhere on the vacuum cleaner 100. For example, the suction motor may be located in the cleaning head 120 which may reduce the weight of the upright section 110 or it may be located in the upright section 110 which may reduce the bulk of the cleaning head 120.

In alternate embodiments, the vacuum cleaner 100 may use an external source of suction. In this alternative, the vacuum cleaner 100 may not include one or more of a suction motor and an air treatment member. This may beneficially reduce the weight and bulk of the vacuum cleaner 100. For example, the vacuum cleaner 100 may be configured to connect to a central vacuum system which provides a source of suction and air treatment. In this example, the upright section 110 may generally comprises a handle 198 and a shaft 199 connected to the cleaning head 120 via the coupling portion 130.

The air treatment member may be any suitable air treatment member. For example, the air treatment member may be a HEPA filter, a carbon filter, one or more cyclonic separator stages, each of which may comprise one or more cyclone separators, a foam filter, a bag filter or a combination thereof. The air treatment member may comprise a single unit at one position along the airflow path or it may comprise disparate components at different positions along the airflow path. For example, the air treatment member may include a cyclonic separator in the upright section 110 and a filter at clean air outlet 145.

Upright section 110 may be of any design known in the art and preferably houses both the air treatment member or members and the suction motor. As exemplified, upright section extends linearly and has a longitudinal axis 155 (See FIG. 2).

The upright section 110 is movably connected to the cleaning head 120 such that the upright section 110 can be moved between an upright, storage position (as exemplified in FIG. 1) and a rearward in-use or declined or floor cleaning position (as exemplified in FIG. 2). The upright section 110 may be rotatably mounted to cleaning head 120 by any means known in the art about a first axis of rotation 200. Preferably, the upright section 110 is pivotally mounted to the cleaning head 120 in which case the first axis of rotation 200 is a pivot axis defined by, e.g. one or more pivot axles.

In some embodiments, the vacuum cleaner 100 may include a lock which inhibits rearward tilting of the upright section 110 when the upright section 110 is in the storage position. In the example shown, the cleaning head 120 includes a lock release control 204 which may be pressed to disengage the lock and permit the upright section 110 to tilt rearwardly into the in-use position. Alternatively, or in addition, the lock may disengage automatically when the upright section 110 is pulled towards the in-use position with a sufficient amount of force. For example, the coupling portion 130 may include a detent plate which a support member engages when moved to the storage position. A threshold amount of force may be required to disengage the detent plate to obtain free the rearward tilting of the upright section 110.

The upright section 110 is also pivotally mounted for movement sideways with respect to the cleaning head 120 between a centered position (as exemplified in FIGS. 1 and 2) and a sideways position (as exemplified in FIG. 3). Preferably, the upright section 110 pivots sideways with respect to the cleaning head 120 about a second axis of rotation 210, which may also be referred to as a pivot axis. Preferably, the second axis of rotation 210 is generally perpendicular to the first axis of rotation 200.

As exemplified, the centered position is one in which the upright section 110 extends linearly upwardly from the cleaning head 120. For example, if the upright section 110 is mounted to the cleaning head along a center line of the cleaning head 120 (i.e. a line extending between the front 160 and rear 170 midway between sides 180, 190), then the upright section 110 preferably extends upwardly such that the upright section 110 is centered above that line. For example axis 155 of upright section 110 preferably is in a plane defined by the horizontal and vertical axis in a sideways position, the upright section is moved laterally such that axis 155 is no longer in a plane defined by the horizontal and vertical axis, e.g., it is at an angle other than 90 degrees to axis 210.

In the example shown, the first axis of rotation 200 is spaced apart from the second axis of rotation 210. Preferably, the second axis of rotation 210 is above the first axis of rotation 200. In alternate embodiments, the first axis of rotation 200 may substantially intersect the second axis of rotation 210. For example, the coupling portion 130 may comprise a universal joint or ball joint configured to permit the upright section 110 to pivot only in the two axes about a central point. In another alternate embodiment, the first axis of rotation 200 may be above the second axis of rotation 210.

Preferably, the upright section 110 can tilt rearwardly and pivot sideways independently. As exemplified in FIGS. 2 and 3, the upright section 110 can pivot sideways without changing the rearward inclination angle 220, without twisting the upright section 110 and without turning or otherwise moving the cleaning head 120.

Alternately, the rearward tilt and sideways pivot of the upright section 110 may be interrelated. For example, the sideways pivoting of the upright section 110 may be inhibited when the upright section 110 is in the storage position (as exemplified in FIG. 1) and uninhibited when the upright section 110 is in the in-use position. In the example shown, the lock release control 204 may be configured to both unlock the rearward tilting and the sideways pivoting of the upright section 110. Alternatively or in addition, the rearward tilt of the upright section 110 may be inhibited when the upright section 110 is in a sideways position and uninhibited when the upright section 110 is in the centered position.

The axis of rotation 200 may be movable with respect to the cleaning head 120. In the example shown, the first axis of rotation 200 is fixed with respect to the cleaning head 120 and is preferably generally parallel to the front 160. In contrast, the exemplary second axis of rotation 210 moves rearwardly with respect to the cleaning head 120 as the upright section 110 is reclined and the rearward inclination angle 220 (which is the angle between the horizontal plane and axis 155) changes.

The axis of rotation 210 may be movable with respect to the cleaning head 120. For example, in FIG. 1 the vacuum cleaner 100 is in the storage position and the second axis of rotation 210 is generally horizontal or parallel to a forward direction 230 of movement. In contrast, in FIG. 3 the vacuum cleaner 100 is in the in-use position and the second axis of rotation 210 is tilted upwardly.

Figure 4:
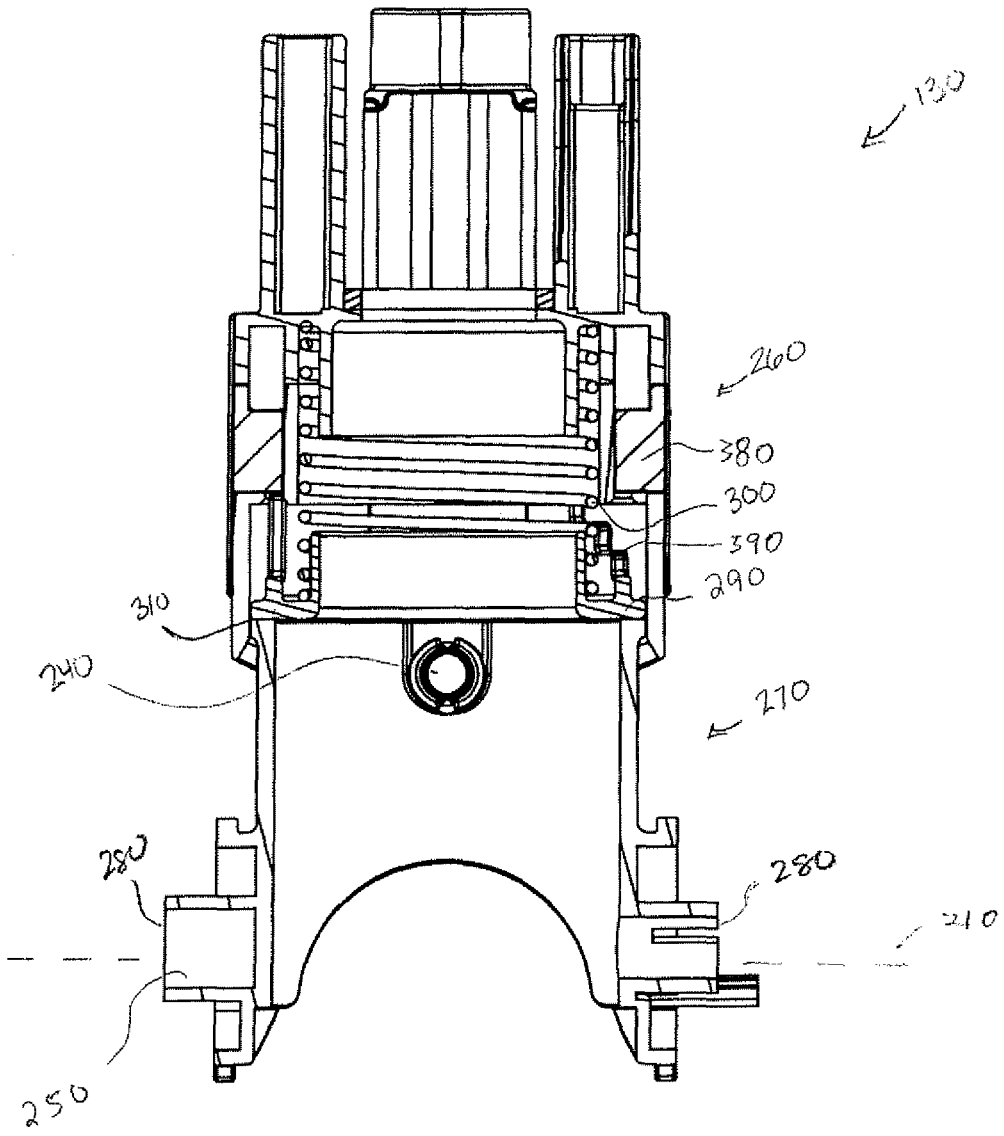
FIG. 4 is a cross section along line 4-4 in FIG. 1 of the vacuum cleaner of FIG. 1 in a centered position.
Figure 5:
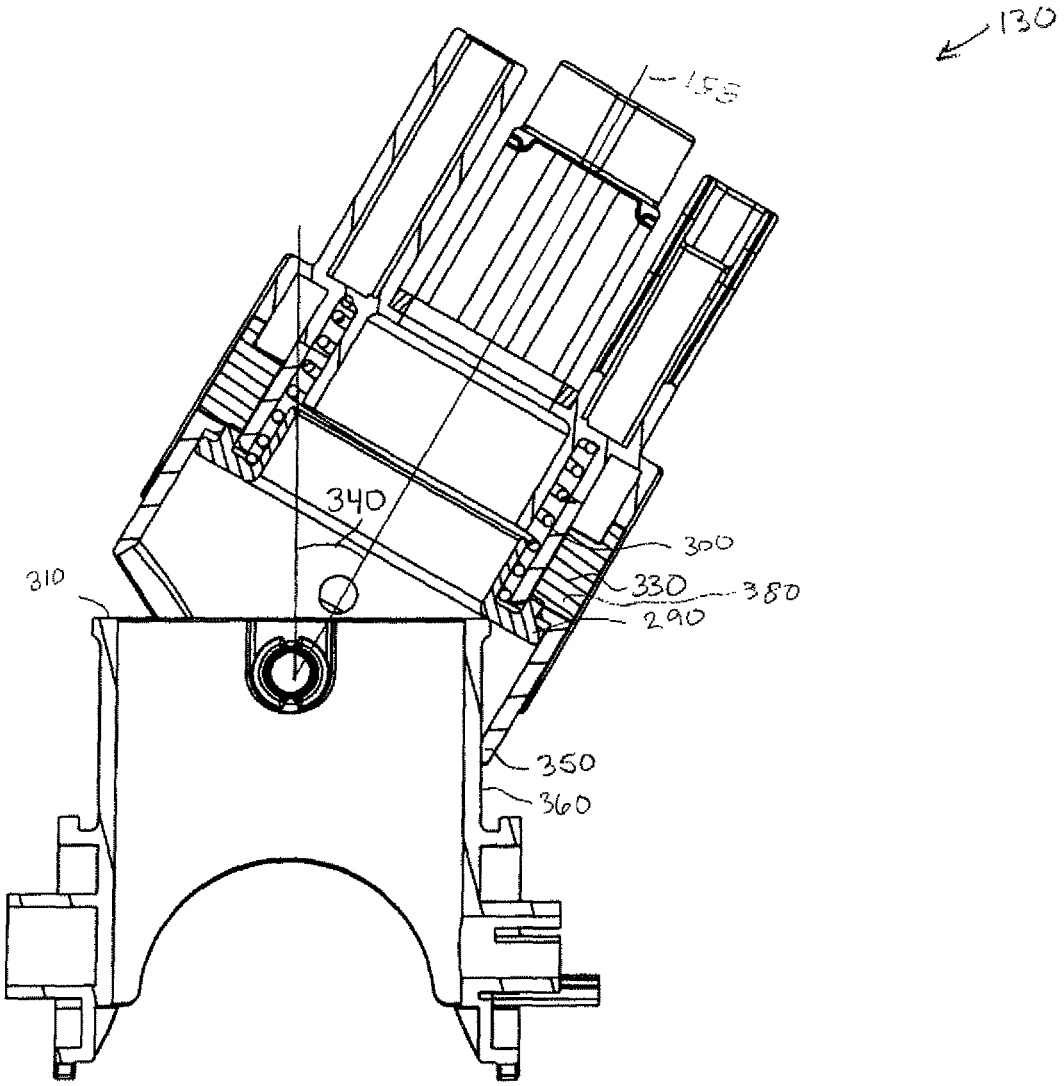

FIGS. 4 and 5 show an example of a coupling portion 130. In the example shown, the coupling portion 130 includes a first pivot 240, a second pivot 250, an upper support member 260 and a lower support member 270. Portions of the coupling portion 130 may form part of the upright section 110, the cleaning head 120 or neither. For example, the lower support member 270 may form part of the cleaning head 120 and the upper support member 260 may form part of the upright section 110. Preferably, the upper support member 260 is at least connected to the upright member 110 for movement therewith and the lower support member 270 is at least connected to the cleaning head 120 for movement therewith.

In the example shown, the first pivot 240 of the coupling portion 130 permits the upright section 110 to rotate about the second axis of rotation 210 (for sideways pivoting of the upright section 110) and the second pivot 250 permits the upright section 110 to rotate about the first axis of rotation 200 (for rearward tilting of the upright section 110).

The lower support member 270 may be pivotally connected with the cleaning head 120 by any suitable means. In the example shown, the lower support member 270 includes the second pivot 250 which includes recesses 280 (e.g. with circular cross sections) that are configured to receive mating protrusions (not shown) from the cleaning head 120. In an alternative example, the lower support member 270 may instead include protrusions which mate with recesses in the cleaning head 120. In some embodiments, the second pivot 250 may comprise an axle (not shown) which extends through both recesses 280 and the rear wheels 150. The axle may facilitate both the rotation of the upright section 110 and the wheels 150.

In the example shown, the upper support member 260 is pivotally connected to the lower support member 270 at the first pivot 240. It will be appreciated that the first pivot 240 may be configured in any suitable way. For example, the first pivot 240 may comprise one or more protrusions from the upper support member 260 which mate with corresponding recesses in the lower support member 270. Alternatively, the first pivot 240 may comprise protrusions from the lower support member 270 which mate with corresponding recesses in the upper support member 260 or a rod connecting the support members 260, 270 together.

The vacuum cleaner 100 may include a biasing member for biasing the sideways tilting of the upright section 110 towards the centered position. In the example shown, the upright section 110 of the coupling portion 130 includes a sleeve 290 with a compression spring 300. When upright section 110 is pivoted sideways in one direction, sleeve 290 rotates about upper end 310 of support 270. This rotation drives sleeve 290 into support 260 thereby compressing spring 300. The compression spring 300 generates an axial force urging the sleeve 290 against the upper edge 310 of support 270. This urges upright section towards the centered position. It will be appreciated that by adjusting the strength of spring 300 more or less axial force may be created. This axial force and also offset some or all of the hand weight that is resolved in the sideways direction.

Alternatively or in addition, the biasing member may comprise a torsional spring (not shown) at the first pivot 240. The torsional spring would provide a torsional counter-force which resists the sideways pivoting of the upper support member 260 (along with the upright section 110). Effectively, the torsional spring would bias the upright section 110 to the centered position where the torque produced by the torsional spring is null.

If the air treatment member is in upright section 110, then the dirty air must be conveyed upwardly thereto. The airflow path may be internal or external to the coupling portion 130. For example, a conduit, such as a flexible hose, may extend from cleaning head 120 to the treatment member external to the supports 260, 270. Alternately, the air flow path may extend through one or both of supports 260, 270. In one embodiment, supports 260, 270 may define a portion of the air flow path. Accordingly, pivot 240 should provide an airtight seal. In another embodiment, a separate member may extend though supports 260, 270 and define a portion of the airflow path. For example, as exemplified in FIG. 6, a flexible hose 320 defines at least a portion of the airflow path which conveys dirty air from the dirty air inlet past the second axis of rotation 210 towards the air treatment member.

Accordingly, one or both of the upper and lower support members 260, 270 may be substantially hollow. Support members may be of any hollow design provided that they have sufficient load strength to support upright section 110. Preferably, they comprise a tubular conduit through which the flexible hose 320 may pass. In the example shown, both of the upper and lower support members 260 and 270 are hollow and the flexible hose 320 passes by the second axis of rotation 210 through the interior of both support members 260, 270.

In alternative embodiments, the flexible hose 320 may extend around the exterior of one or more of the upper and lower support members 260, 270. In another alternative, the upper and lower support members 260, 270 may be hollow but only partially enclosed. That is at least a portion of the interior of the support member may be exposed to the outside by an opening in a sidewall of the support member. In this alternative, the flexible hose 320 can pass through the interior of the support members 260, 270 with a portion of the flexible hose 320 being exposed to the exterior.

Alternatively, the portion of the airflow path which extends past the second axis of rotation 210 may not include a flexible hose. For example, the upper and lower support members 260, 270 may themselves form a substantially air tight conduit for conveying dirty air from the dirty air inlet towards the air treatment member.

In a further alternative, the portion of the airflow path from the dirty air inlet towards the air treatment member may not pass by the second axis of rotation 210. For example, where the vacuum cleaner 100 is connected to a central vacuum system, a hose may extend from the cleaning head 120 along the floor towards a connection to the central vacuum system.

The vacuum cleaner 100 may include a pivot limiter 330 delimiting the sideways pivoting of the upright section to a maximum sideways pivot angle from the centered position. Accordingly, when the vacuum cleaner 100 is in use, the user may pivot the upright section 110 sideways. However, the angle to which the upright section may be moved is preferably limited. Optionally, the pivot limiter may be configured to provide a plurality of different maximum sideways pivot angles.

It will be appreciated that the pivot limiter 330 may take any suitable form. In general, any portion which is configured to be abutted at the maximum pivot angle, preventing further sideways pivoting, can operate as a pivot limiter. For example, as exemplified by FIG. 5, when the upright section 110 is pivoted sideways, the side wall 350 of the upper support member 260 approaches the side wall 360 of the lower support member 270 (the pivot limiter in this example) until they abut at the maximum pivot angle 340 inhibiting further sideways pivoting in that direction. Accordingly, any tow interacting members may be utilized.

In some embodiments, the pivot limiter 330 may be adjustable and comprise a selector 370 for setting the maximum pivot angle. For example, the pivot limiter 330 may comprise a plurality of first interacting members and one of the support members 260, 270 may comprise a second interacting member, and one of the first interacting members and the second interacting member abut when the upright section 110 is positioned at a set variable maximum sideways pivot angle. A selector 370 that is adjustable to select one of the plurality of maximum sideways pivot angles may be provided in such an embodiment. The selector 370 may be part of the pivot limiter. For example, the pivot limiter may itself be moveable, e.g., rotatable so as enable a user to selectively align different first interacting members with the second interacting member. Alternately, the selector may comprise the second interacting member and the selector is moveable to selectively align the second interacting member with different first interacting members.

FIG. 7 and FIGS. 8A to 8D show a partially exploded and cut away view of part of an exemplary coupling portion 130 including a selector 370 for selecting the maximum pivot angle 340 and a pivot limiter 330. Pivot limiter 330 comprises a plurality of different recesses, slots or first interacting members 390. Selector 370 includes a stop, inward protrusion or second interacting member 380.

Referring to FIGS. 4 and 6, when the upright section 110 is in the centered position, sliding sleeve 290 rests on the top of support 270 and stop 380 is spaced from an aligned recess 390. When the upright section 110 is pivoted sideways, the sleeve 290 rises inside of the upper support member 260 as sleeve 290 cams over the top of support 270 to the position shown in FIG. 5 in which it abuts the stop 380 at the maximum pivot angle 340, thereby inhibiting further sideways pivoting in that direction.

In this configuration, when the upright section 110 is pivoted sideways, the sliding sleeve 290 is free to slide upwardly until the interacting member 380 abuts the interacting member 390 with which it is aligned. It will be appreciated that when stop 380 engages a recess 390, the sideways movement of upright section 110 will be terminated thereby defining a maximum sideways pivot angle.

One or both of the selector 370 and pivot limiter 330, and preferably the selector, is movable to selectively align the interacting member 380 with one of the plurality of interacting members 390. It will be appreciated that one of the selector 370 and pivot limiter 330 may be provided on one of supports 260 and 270 and the other of the selector 370 and pivot limiter 330 may be provided on the other support 260, 270. As exemplified, Preferably, the selector 370 is rotatably mounted to the upper support member 260 and pivot limiter is provided on lower support 270.

It will be appreciated that the selector 370 and the interacting members 380, 390 may be provided at any suitable location in the vacuum cleaner 100. In the example shown, the interacting members 390 are provided in the sliding sleeve 290 below the selector 370. In alternate examples, however, the selector 370 may be integrated with the sliding sleeve 290 and the upper support member 260, above the sliding sleeve 290, may instead comprise the interacting members 390.

In any case, a portion of the selector 370 should preferably be directly or indirectly accessible from the outside of the vacuum cleaner 100 such that a user may move it to select a maximum pivot angle 340.

Figure 8A:
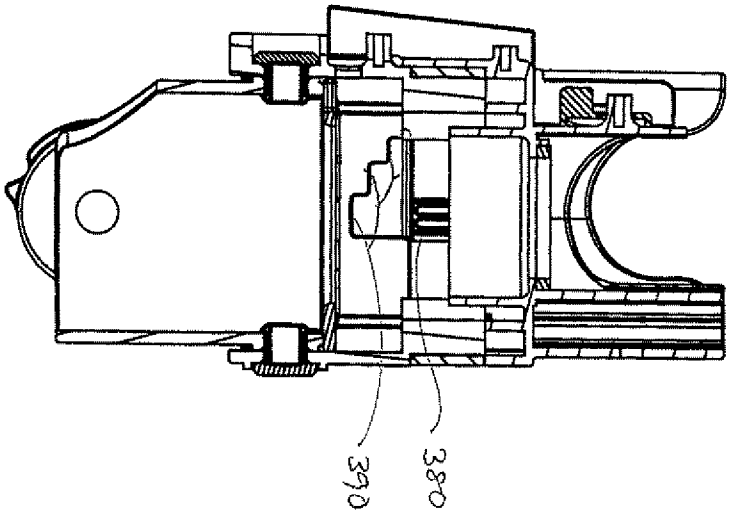
Figure 8B:
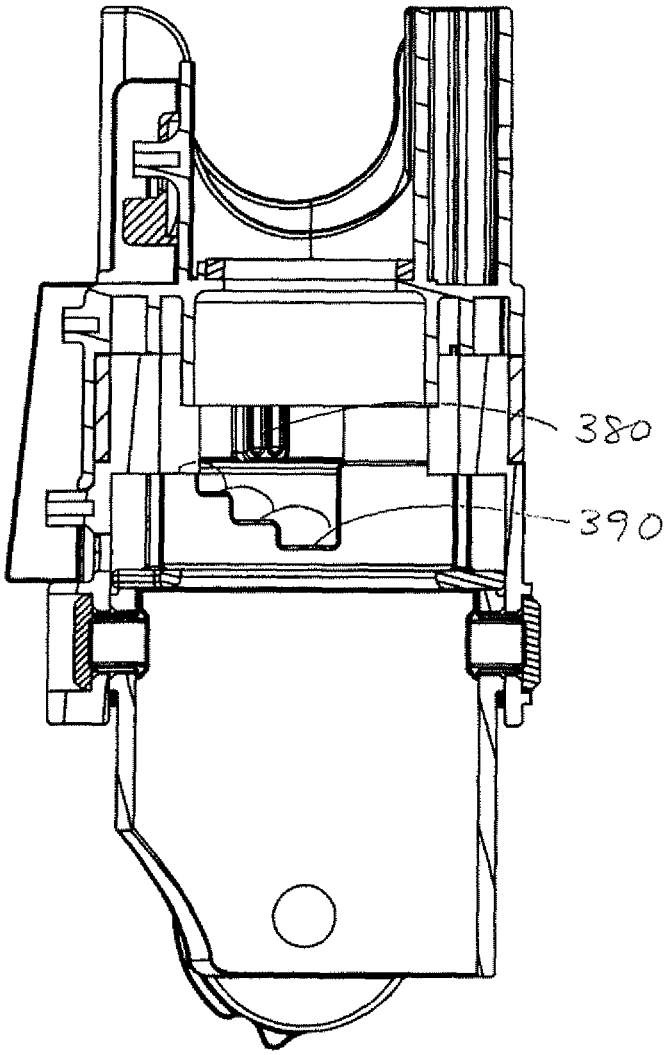
Figure 8C:
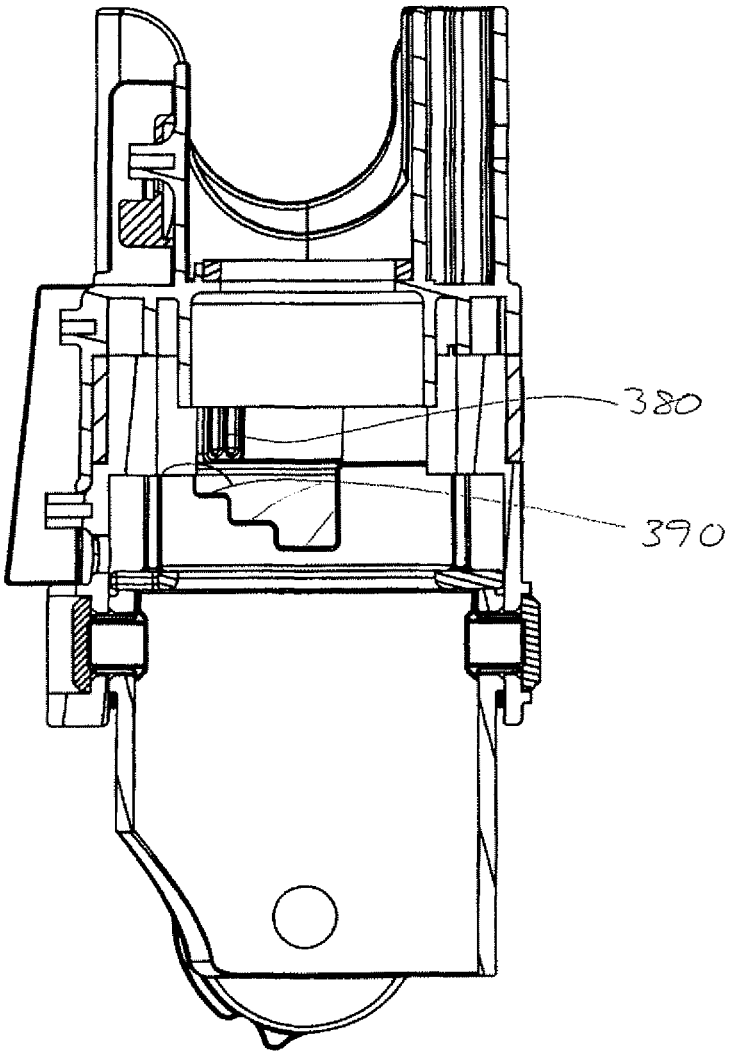

FIGS. 8A to 8D exemplify the use of selector 370 to set different maximum sideways pivot angles. In FIG. 8A, the greatest of the selectable maximum pivot angles 340 is selected. That is, interacting member 380 is aligned with the interacting member 390 that is the furthest away such that the sliding sleeve 290 has the greatest range of motion before the interacting member 380 abuts with an interacting member 390.

Figure 8D:
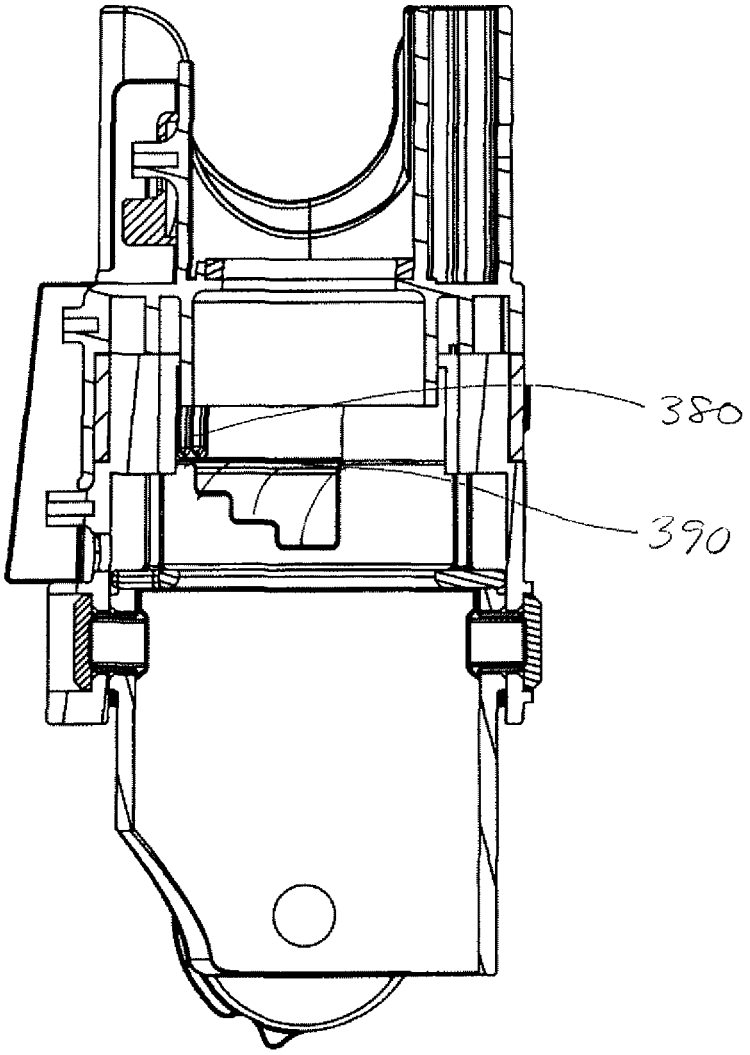

FIG. 8D shows the selector 370 configured as a pivot lock. The selector 370 is positioned such that the interacting member 380 abuts an interacting member 390 when the upright section 110 is in the centered position. Accordingly, the upright section 110 is inhibited from pivoting sideways because any sideways pivoting would require the sliding sleeve 290 to rise and the sliding sleeve 290 is blocked from moving by the abutment of the interacting members 380, 390.

It will be appreciated that the pivot limiter 330 and selector 370 may take any suitable form. For example, the selector 370 may be configured with a plurality of recesses which may be moved to align with a singular protrusion positioned on the sliding sleeve 290. Alternatively, the selector 370 may be configured with a plurality of protrusions which may be moved to align with a single recess in the sliding sleeve 290. In another alternative, the selector 370 may be configured with a plurality of protrusions which may be moved to align with a protrusion on the sliding sleeve 290. In still another alternative, the selector 370 may be configured with a single protrusion configured to align above a wide continuously sloped recess (instead of the stepped configuration of interacting members 390 as shown) which may provide for a virtually unlimited selection of maximum pivot angles 340 within a range.

The present invention has been described here by way of example only. Various modification and variations may be made to these exemplary embodiments without departing from the spirit and scope of the invention, which is limited only by the appended claims.

I claim:

1. A surface cleaning apparatus comprising:

a cleaning head having a front, a rear, two opposed sides extending between the front and the rear, and a bottom;

a coupling portion coupled to the cleaning head, the coupling portion including a first axis of rotation and a second axis of rotation, wherein the coupling portion defines a cavity;

an upright section coupled to the coupling portion, wherein the upright section is movable about the first axis of rotation between a storage position and a rearward in-use position and is movable sideways, relative to the cleaning head, about the second axis of rotation between a centered position and a sideways position;

a sleeve extending around a longitudinal axis of the upright section and slideably engaging a surface of the coupling portion, at least a portion of the sleeve being disposed within the cavity of the coupling portion, wherein a movement of the coupling portion about the second axis of rotation causes the entire sleeve to slide in a common direction along the longitudinal axis of the upright section such that the sleeve slides towards the upright section; and a biasing member disposed within the coupling portion, wherein the biasing member biases the upright section from the sideways position towards the centered position in response to the sleeve sliding along the longitudinal axis of the upright section.

2. The apparatus of claim 1 wherein the second axis of rotation is above the first axis of rotation.

3. The apparatus of claim 1 wherein the first axis of rotation is generally parallel to the front and the second axis of rotation is generally parallel to a forward direction of motion of the cleaning head.

4. The apparatus of claim 1 further comprising a pivot lock inhibiting the sideways pivoting of the upright section.

5. The apparatus of claim 1 further comprising a pivot limiter delimiting the sideways pivoting of the upright section to a maximum sideways pivot angle from the centered position.

6. The apparatus of claim 5 wherein the pivot limiter comprises at least a first interacting member which is engaged when the upright section is pivoted sideways to the maximum sideways pivot angle.

7. The apparatus of claim 5 wherein the pivot limiter defines a plurality of maximum sideways pivot angles.

8. The apparatus of claim 7 further comprising a selector that is adjustable to select one of the pluralities of maximum sideways pivot angles.

9. The apparatus of claim 8 wherein the selector is part of the pivot limiter.

10. The apparatus of claim 9 wherein the cleaning head comprises a first support member and the upright section comprises a second support member, each of the support members extending along the longitudinal axis and the pivot limiter is rotatably mounted to one of the support members for rotation about the longitudinal axis.

11. The apparatus of claim 10 wherein the pivot limiter comprises a plurality of first interacting members and the other of the support members comprises a second interacting member, and one of the first interacting members and the second interacting member abut when the upright section is positioned at a set variable maximum sideways pivot angle.

12. The apparatus of claim 10 wherein the pivot limiter is rotatably mounted to the second support member.

13. The apparatus of claim 11 wherein the first interacting members are arranged at various distances from the second interacting member when the upright section is in the centered position and the selector is rotatable to align one of the first interacting members with the second interacting member.

14. The apparatus of claim 11 wherein the first interacting members comprise a plurality of recesses and the selector is rotatable to align one of the recesses with the second interacting member.

15. The apparatus of claim 1 further comprising:

an airflow path extending from a dirty air inlet to a clean air outlet; and a suction motor and an air treatment member positioned in the airflow path.

16. The apparatus of claim 15 further comprising a flexible hose defining at least a portion of the airflow path that conveys dirty air past the second axis of rotation.

17. The apparatus of claim 16 further comprising a first hollow support member pivotally connected to a second hollow support member wherein the flexible hose extends through the interior of the first and second hollow support members.

18. The apparatus of claim 17 wherein each hollow support member comprises a tubular conduit.

19. The apparatus of claim 1, wherein the first axis of rotation is parallel with the front of the cleaning head, the second axis of rotation is transverse to the front of the cleaning head, and the longitudinal axis is transverse to both the first and second axes of rotation.

20. A surface cleaning apparatus comprising:

a cleaning head having a front, a rear, two opposed sides extending between the front and the rear, and a bottom;

a coupling portion coupled to the cleaning head, the coupling portion including a first axis of rotation and a second axis of rotation, wherein the coupling portion defines a cavity;

an upright section coupled to the coupling portion, wherein the upright section is movable about the first axis of rotation between a storage position and a rearward in-use position and is movable sideways, relative to the cleaning head, about the second axis of rotation between a centered position and a sideways position;

a sleeve extending around a longitudinal axis of the upright section and at least partially disposed within the cavity of the coupling portion, the sleeve slideably engaging a surface of the coupling portion, wherein a movement of the coupling portion about the second axis of rotation causes the sleeve to slide in a direction of the upright section and along the longitudinal axis of the upright section; and a biasing member disposed within the coupling portion, wherein the biasing member biases the upright section from the sideways position towards the centered position in response to the sleeve sliding along the longitudinal axis of the upright section.

21. A surface cleaning apparatus comprising:

a cleaning head having a front, a rear, two opposed sides extending between the front and the rear, and a bottom;

a coupling portion having an upper support and a lower support, the lower support being coupled to the cleaning head and the upper support defining a cavity for receiving at least a portion of the lower support, wherein the coupling portion includes a first axis of rotation and a second axis of rotation;

an upright section coupled to the upper support, wherein the upright section is movable about the first axis of rotation between a storage position and a rearward in-use position and is movable sideways, relative to the cleaning head, about the second axis of rotation between a centered position and a sideways position;

a sleeve extending around a longitudinal axis of the upright section and slideably engaging a surface of the upper support, at least a portion of the sleeve being disposed within the cavity of the upper support, wherein a movement of the coupling portion about the second axis of rotation causes the sleeve to slide in a direction of the upright section and slide parallel to the longitudinal axis of the upright section; and a biasing member disposed within the coupling portion, wherein the biasing member biases the upright section from the sideways position towards the centered position in response to the sleeve sliding along the longitudinal axis of the upright section.

* * * * *